US005186561A

United States Patent [19]

Ackermann et al.

[11] Patent Number: 5,186,561

[45] Date of Patent: Feb. 16, 1993

[54] INCREMENTAL FEEL COSMETIC DISPENSER

[75] Inventors: Walter Ackermann, Watertown; Thomas F. Holloway, Southbury, both of Conn.

[73] Assignee: Risdon Corporation, Naugatuck, Conn.

[21] Appl. No.: 852,774

[22] Filed: Mar. 17, 1992

[51] Int. Cl.[5] ..... A45D 40/00; A45D 40/06

[52] U.S. Cl. ..... 401/78; 401/80; 401/194

[58] Field of Search ..... 401/80, 78, 68, 194

[56] References Cited

U.S. PATENT DOCUMENTS

| | | | |
|---|---|---|---|
| 1,950,324 | 3/1934 | Powers | 401/194 |
| 2,022,075 | 11/1935 | Cabrera | 206/56 |
| 2,840,229 | 6/1958 | Hopgood | 206/56 |
| 2,840,231 | 6/1958 | Reichenbach | 206/56 |
| 2,858,937 | 11/1958 | Hoffman | 206/56 |
| 2,913,103 | 11/1959 | Isele | 206/56 |
| 3,272,327 | 9/1966 | Busch | 206/56 |
| 3,298,509 | 1/1967 | Hultgren | 206/56 |
| 3,335,858 | 8/1967 | Geisel | 206/56 |
| 3,515,493 | 6/1970 | Gruska | 401/78 X |
| 3,539,266 | 11/1970 | Hultgren | 401/78 |
| 3,620,632 | 11/1971 | Gruska | 401/78 |
| 3,850,183 | 11/1974 | Gruska | 132/88.7 |
| 4,595,124 | 6/1986 | Duval et al. | 401/194 |
| 4,750,501 | 6/1988 | Ackerman et al. | 401/80 X |
| 4,812,066 | 3/1989 | Gueret | 401/78 |

FOREIGN PATENT DOCUMENTS

| | | | |
|---|---|---|---|
| 2029132 | 12/1971 | Fed. Rep. of Germany | 401/78 |
| 3118893 | 11/1982 | Fed. Rep. of Germany | 401/68 |
| 3812777 | 10/1989 | Fed. Rep. of Germany | 401/68 |
| 1118889 | 5/1968 | United Kingdom | 401/78 |

*Primary Examiner*—Steven A. Bratlie

*Attorney, Agent, or Firm*—St.Onge Steward Johnston & Reens

[57] ABSTRACT

A cosmetic preparation dispenser is provided that has an incremental feel created by the interaction of a resilient tab extending outwardly from the dispenser's innerbody with a plurality of rib elements provided on a surrounding wall of a cam sleeve so that the tab cams up and down on the ribs to increase and decrease resistance to relative rotation of innerbody and cam sleeve to give the desired incremental feel.

15 Claims, 4 Drawing Sheets

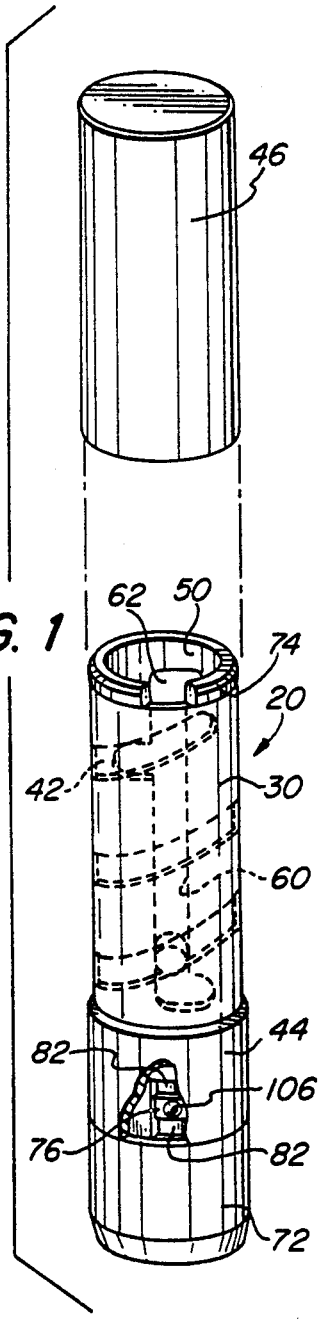
FIG. 1
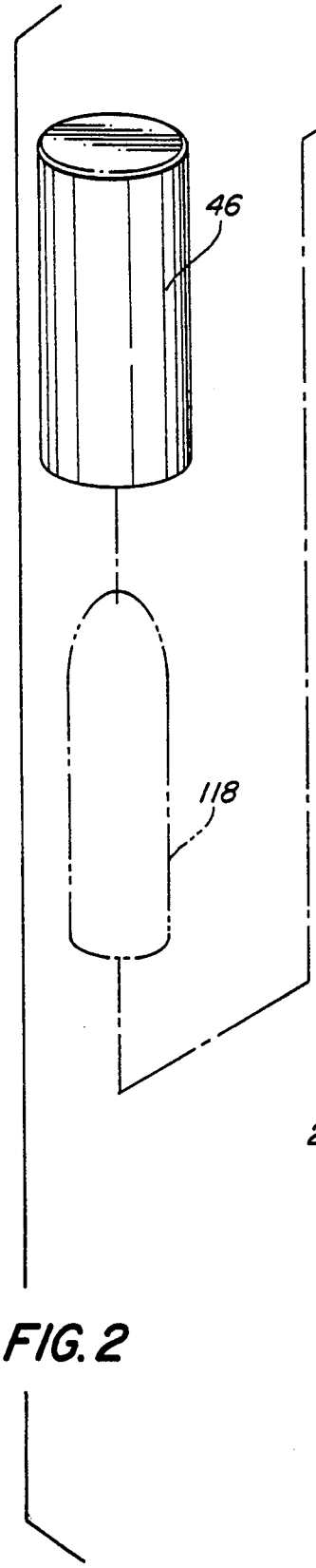
FIG. 2
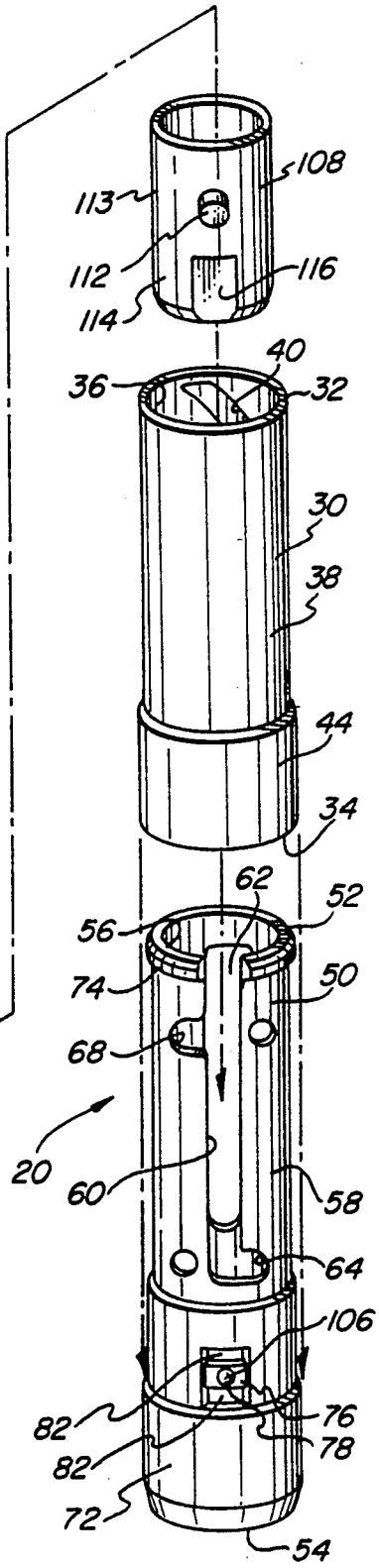

INCREMENTAL FEEL COSMETIC DISPENSER

FIELD OF THE INVENTION

The present invention relates to the field of cosmetic and lipstick dispensers, and particularly to a dispenser having a unique incremental feel in the extension and retraction of a cosmetic stick.

BACKGROUND OF THE INVENTION

Conventional propel/repel lipstick dispensers typically have an outer helical cam track sleeve and a longitudinal track innerbody rotatable inside the cam sleeve to axially propel and retract an elevator cup with a lug or lugs that track in the cam track and in the longitudinal track. One such conventional dispenser is disclosed, for example, in Hultgren, U.S. Pat. No. 3,298,509.

It is known in the art to provide cosmetic dispensers such as lipstick cases that have a high friction feel to the consumer operator when the dispenser is operated to extend or retract the cosmetic stick. The prior art has attempted to provide the frictional torque by a number of devices. U.S. Pat. No. 4,750,501 to Ackermann et al. is an example of one type of cosmetic applicator wherein an objective is to impart an even drag and swivel torque during operation. In other prior art devices, two lugs or tabs are provided on the elevator cup to press against the innerbody or the cam sleeve to provide frictional interference therebetween. However, it has not otherwise been generally known to create other types of dispensing feel in a cosmetic dispenser.

SUMMARY OF THE INVENTION

It is an object of the invention to provide an improved cosmetic preparation dispenser having a desirable "digital feel" suggesting incremental extensions and retractions of the cosmetic stick.

In accordance with the present invention, an innerbody flex tab cosmetic dispenser comprises a cam sleeve with an inner helical track, an innerbody with longitudinal tracks, and an elevator cup with a cam follower lug that permits the cup to move in an axial path by relative rotation of the innerbody and cam sleeve. The innerbody is provided with at least one and preferably two or more resilient flex tabs. The resilient flex tabs are formed with and attached to the lower end of the innerbody, and are at least partially cut away from the innerbody. A plurality of axially extending ribs are formed on the inner wall of the lower end of the cam sleeve so that the tabs will press against the ribs to provide the digital feel upon the relative rotation of the innerbody and cam sleeve.

In an alternative embodiment, it is possible to locate the flex tabs on the cam sleeve so that they extend radially inwardly to bear against ribs formed on the outer radial surface of the innerbody. In such case it is desirable to have an outer annular wall provided on the innerbody to wrap around the cam sleeve and the flex tabs to keep the flex tabs from escaping radially outwardly.

Other objects, aspects and features of the present invention in addition to those mentioned above will be pointed out in or will be understood from the following detailed description provided in conjunction with the accompanying drawings.

BRIEF DESCRIPTION OF THE DRAWINGS

FIG. 1 is a perspective view of an embodiment of an incremental feel cosmetic dispenser in accordance with the invention with a partial cutaway showing one of the frictional flex tabs of the present invention.

FIG. 2 is an exploded view of the dispenser of FIG. 1.

DETAILED DESCRIPTION OF THE PREFERRED EMBODIMENT

Figure 3:
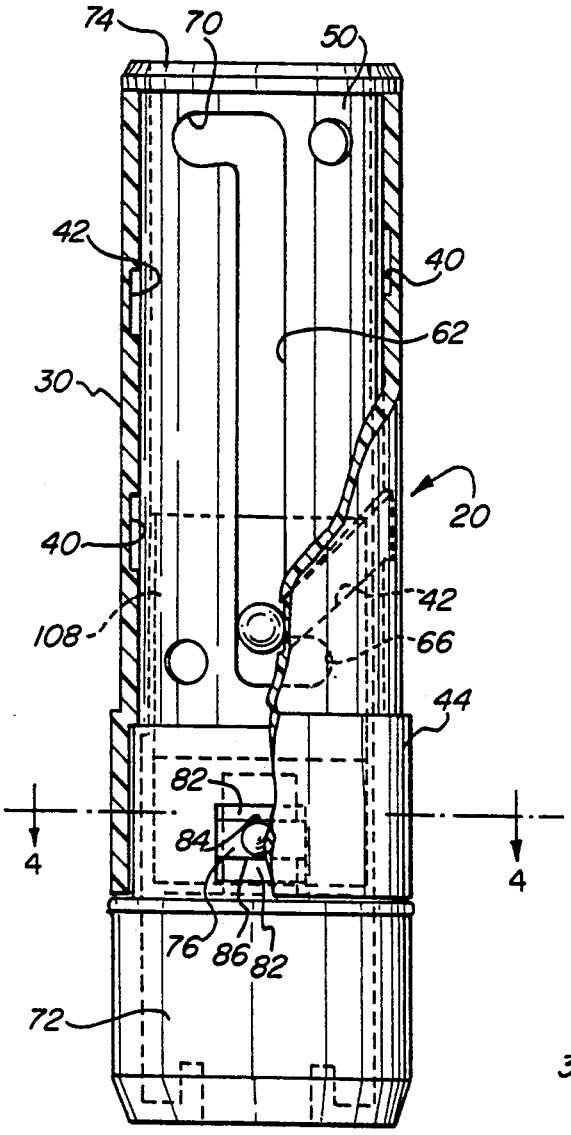
FIG. 3 is a side elevation view of the dispenser of FIG. 1 with partial cutaway.

Referring now to FIGS. 1-12, where like elements are identified by like numbers in the drawings, an incremental feel cosmetic dispenser is shown generally at 20. Dispenser 20 comprises a cam sleeve 30, an innerbody 50, and an elevator cup 108.

Cam sleeve 30 is rigid and tubular and has an upper end 32 and a lower end 34. Cam sleeve 30 has an inner wall 36 and an outer wall 38. At least one and preferably two internal helical threads 40 and 42 are formed on the inner wall 36. Helical threads 40 and 42 are located 180 degrees apart and extend along a substantial length of the inner wall 36 of the cam sleeve 30. Cam sleeve 30 has an unthreaded lower inner wall seqment 44 at its lower end 34 which is provided with a plurality of rib elements for the desired digital or ratchet feel. The rib elements comprise a plurality of axially extending ribs 33 formed on the inner wall 36 of the lower end 34 of the cam sleeve 30. The flex tabs 76, 88 or 96 of the innerbody 50 fitted inside such a cam sleeve 30 will press against the ribs 33 such that a "digital" or "ratchet" feel is provided upon the relative rotation of the innerbody 50 and cam sleeve 30. An ornamental outer shell 46 such as a brass tube may be fitted over the outer wall 38 of the cam sleeve for decoration.

Innerbody 50 is also tubular and has an upper end 52 and a lower end 54. Innerbody 50 has an inner wall 56 and an outer wall 58. Innerbody 50 is fitted into the cam sleeve 30 and has at least one and preferably two longitudinal tracks 60 and 62 which extend along the axial length of the innerbody 50 and which extend through the walls 56 and 58 of the innerbody 50 along a substantial length of the innerbody 50. Preferably, one of the longitudinal tracks 60 extends to the upper end 52 of the innerbody 50 so that it is open at its upper end. The other longitudinal track 62 preferably does not so extend so that it is closed at its upper end.

The longitudinal tracks 60 and 62 have at their lower ends lower lateral track segments 64 and 66 respectively which preferably extend perpendicularly from the longitudinal tracks 60 and 62. The longitudinal tracks 60 and 62 preferably also have at their upper ends upper lateral track segments 68 and 70 respectively which preferably also extend perpendicularly from the longitudinal tracks 60 and 62. Preferably, the upper lateral tracks 68 and 70 extend in the opposite direction from the lower lateral tracks 64 and 66. The upper lateral track segments 68 and 70 assist the elevator cup 108 to be locked in an extended position for application of a cosmetic.

The innerbody 50 is interlocked with the cam sleeve 30 so that rotation or application of a swivel torque to the cam sleeve 30 relative to innerbody 50 can be accomplished by gripping an extended cylindrical knob portion 72 on innerbody 50 with one hand, and cam sleeve 30 with the other hand to raise or lower elevator cup 108 as set forth hereafter. The cam sleeve 30 and innerbody 50 are preferably secured together by a retaining lip 74 on the upper end 52 of innerbody 50 that retains the upper end 32 of cam sleeve 30 in place on innerbody 50. The knob 72 of innerbody 50 has a larger diameter than the lower end 34 of cam sleeve 30 and thereby holds the cam sleeve lower end 34 in place. Alternative retaining means might also comprise an interfitting combination of a rib and channel for receiving the rib.

At least one and preferably two resilient flex tabs 76 are formed with and attached to the innerbody 50 above knob 72. The two flex tabs 76 are located about 180 degrees apart. The tabs 76 are at least partially cut away from the innerbody 50 to enhance resilience. The flex tabs 76 have various embodiments as described hereafter and each has sufficient resilience to be flexed radially inwardly.

Figure 5:
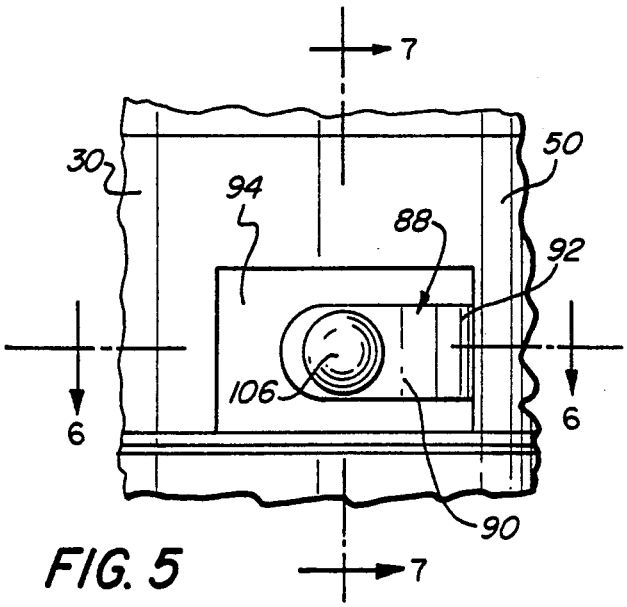
FIG. 5 is a detail side elevation view of a second embodiment of the flex tab of an embodiment of a dispenser.
Figure 11:
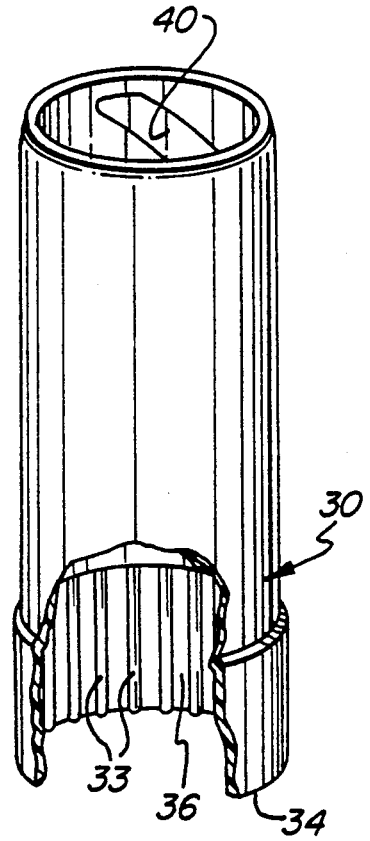
FIG. 11 is a perspective view of the cam sleeve of the dispenser with a breakaway view of the plurality of ribs.
Figure 12:
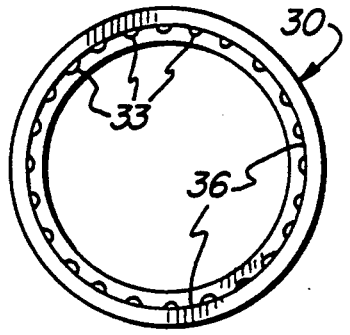
FIG. 12 is a cross sectional view of the cam sleeve of FIG. 11 showing the plurality of ribs engageable by flex tabs to give the digital feel.
Figure 4:
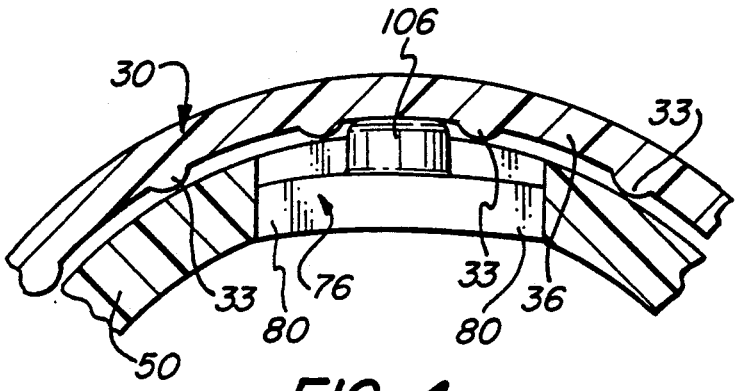
FIG. 4 is a detail cross sectional view of one of the flex tabs of the dispenser of FIG. 3 along the line 4—4, showing the interaction of the flex tab and the plurality of ribs.
Figure 6:
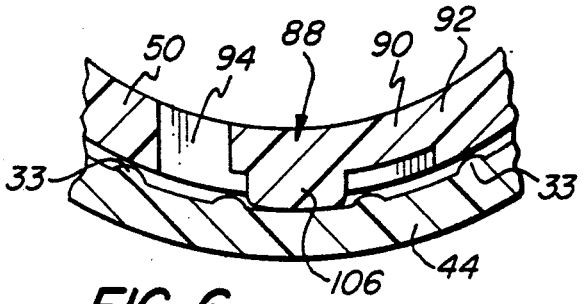
FIG. 6 is a detail cross-sectional view of the flex tab of FIG. 5 along the line 6—6 thereof.
Figure 7:
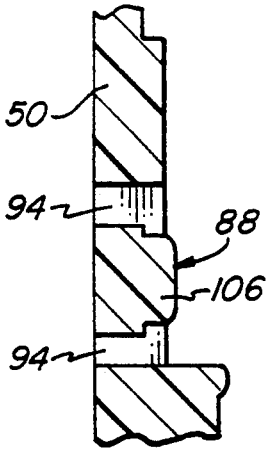
FIG. 7 is a detail cross-sectional view of the flex tab of FIG. 5 along the line 7—7 thereof.
Figure 8:
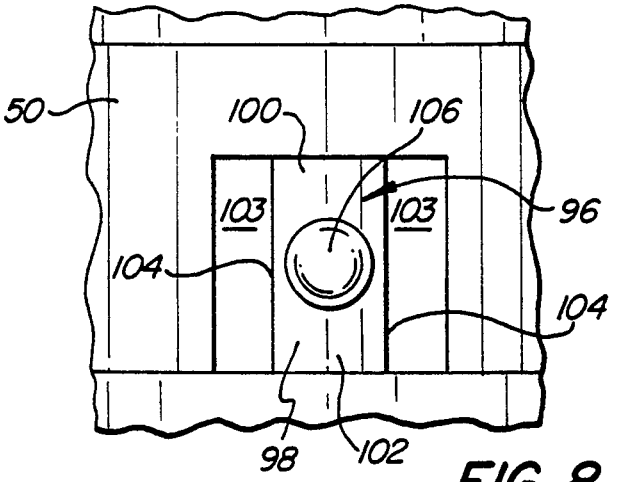
FIG. 8 is a detail side elevation view of a third embodiment of the flex tab of an embodiment of a dispenser.
Figure 9:
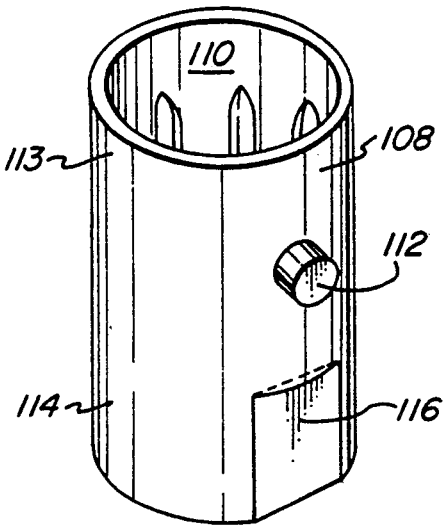
FIG. 9 is a perspective view of an embodiment of an elevator cup of a dispenser in accordance with the invention.
Figure 10:
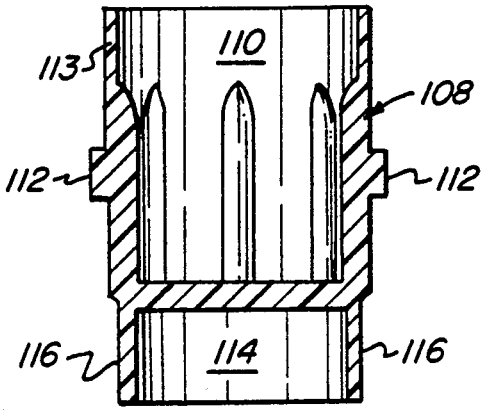
FIG. 10 is a cross-sectional view of the elevator cup of FIG. 9.

Referring now to FIGS. 1–4, an embodiment of a flex tab is shown at 76 and is a horizontal element 78 which is attached at its two horizontal ends 80 to the innerbody 50. The flex tab 76 is cutaway from and separated from the innerbody 50 by spaces 82 located along the upper edge 84 and lower edge 86 of the horizontal element. Another embodiment of the flex tab is shown in FIGS. 5–7 as 88 and comprises a horizontal element 90 attached at only one horizontal end 92 to the innerbody 50. Flex tab 88 is therefore cutaway and separated from the innerbody 50 by spaces 94 located along three edges of the horizontal element 90. A further embodiment of a flex tab is shown in FIG. 8 as 96 and comprises a vertical element 98 attached at two vertical ends 100 and 102 to the innerbody 50. Flex tab 96 is therefore cutaway and separated from the innerbody 50 by spaces 103 located along lateral edges 104 of the vertical element 98.

The flex tabs 76, 88 or 96 are preferably provided with a radially outwardly extending bump 106 to provide a frictional engagement with the ribs 33 on the lower inner segment 44 of the cam sleeve 30. Bump 106 preferably has a generally hemispherical shape with a flattened frictional surface.

The digital or ratchet feel is created by the interaction of the resilient tab or tabs 76, 88 or 96 with the surrounding plurality of rib elements 33 in which the tab or tabs 76, 88 or 96 cam up and down on the ribs 33 to increase and decrease the resistance to relative rotation between the innerbody 50 and cam sleeve 30. If there are two such tabs, they should be located so that their camming movement is synchronized during relative rotation of the inner body 50 and cam sleeve 30.

In an alternative embodiment, it is possible to locate the flex tabs on the cam sleeve so that they extend radially inwardly to bear against ribs located on a radial surface of the innerbody. Such ribs would comprise a plurality of axial ribs similar to ribs 33 so that the digital feel is provided. In such case it is desirable to have an outer annular wall provided on the innerbody to wrap around the cam sleeve and the flex tabs to keep the flex tabs from escaping radially outwardly.

Referring now to FIGS. 1–12, the elevator cup 108 is generally cylindrical and has a chamber 110 for containing a cosmetic preparation such as lipstick. The cup 108 is fitted into the innerbody 50. Cup 108 has at least one and preferably two cam follower lugs 112 for seating in and following in the longitudinal tracks 60 and 62 of the innerbody 50 and the helical threads 40 and 42 of the cam sleeve 30. The lugs 112 are located 180 degrees apart and have a sufficient length to extend through the longitudinal tracks 60 and 62 to engage the helical threads 40 and 42. The cup 108 has an upper segment 113 and a lower skirt 114. Located below the lugs 112 are reduced radius zones 116 in skirt 114. In the reduced radius zones 116 the cup 108 has a lesser radius than in the upper segment 113. The reduced radius zones 116 are preferably rectangular flat areas located below lugs 112.

Cup 108 is movable in an axial path by relative rotation of the innerbody 50 and cam sleeve 30 by virtue of the lugs 112 seating in the helical threads 40 and 42 of cam sleeve 30 and the longitudinal tracks 60 and 62 of innerbody 50. The relative rotation of the cam sleeve 30 and innerbody 50 causes the cup 108 to move axially to propel the elevator cup 108 to an extended position, and relative rotation in the opposite direction causes the elevator cup 108 to retract to a retracted position as shown in FIG. 3. In the preferred embodiment, the helical threads 40 and 42 are right hand threads in the cam sleeve 30 and have a thread pitch of about 30 degrees so that each makes one complete revolution as the cup 108 traverses the length of the dispenser 20. This is desirable as only a single turn is needed to fully activate the dispenser 20.

During the extension and retraction of cup 108 a unique incremental feel is given by the camming of the flex tabs on ribs 33. The consumer user feels that the cup 108 is advanced in increments until it is fully extended. Similarly, the retracting cup 108 feels as if it is being withdrawn by increments back into the dispenser 20.

The innerbody 50 and the cam sleeve 30 are preferably formed by molding from a thermoplastic such as styrene. The flex tabs are molded into the innerbody and provide the additional benefit of pierced walls in the innerbody that correspond to holding ribs in a mold that help to hold a core pin in an upright and steady position during the molding process.

Typically, a cap will also be provided with the dispenser 20. Such a cap has a lower end suited for fitting over the cam sleeve and its decorative shell, and can be frictionally mounted on the lower end of the innerbody 50. For decorative enhancement, the cap and the lower end of innerbody 50 may also have decorative shells fitted over them. These decorative shells may be affixed to their respective underlying structural components by gluing and/or by forming their ends to clip onto the ends of the cam sleeve, cap and innerbody lower end.

The present invention therefore provides a new and useful cosmetic dispenser with a unique incremental feel. It is to be appreciated that the foregoing is illustrative and not limiting of the invention, and that various changes and modifications to the preferred embodiments described above will be apparent to those skilled in the art. For example, the positions of the ribs 33 and the flex tabs may be relocated within the dispenser; or the shape and spacing of the ribs may be altered; or another mechanism equivalent to the flex tab may be substituted. Such changes and modifications can be made without departing from the spirit and scope of the present invention, and it is therefore intended that such changes and modifications be covered by the following claims.

What is claimed is:

1. An incremental feel cosmetic dispenser, comprising:

a tubular cam sleeve having upper and lower ends and inner and outer walls and having an internal helical thread extending along a substantial length of the inner wall of said cam sleeve;

a plurality of rib elements provided on said inner wall of said lower end of said cam sleeve, said rib elements extending generally axially along said cam sleeve inner wall;

a tubular innerbody having upper and lower ends, said innerbody being fitted into said tubular cam sleeve and being provided with a longitudinal track extending through the wall of said innerbody along a substantial length of said innerbody;

a resilient round ended tab formed with and attached to said lower end of said innerbody and being at least partially cut away form said innerbody, said tab extending radially outwardly sufficiently to cam against said ribs of said cam sleeve such that a manual sensation of an incremental feel is provided to a user upon the relative rotation of said inner body and cam sleeve in both a dispensing and a retracting direction.

2. An incremental feel cosmetic dispenser in accordance with claim 1, wherein there are two said resilient tabs.

3. An incremental feel cosmetic dispenser in accordance with claim 2, wherein said two resilient tabs are located 180 degrees apart on opposite sides of said innerbody.

4. An incremental feel cosmetic dispenser in accordance with claim 1, wherein said resilient tab comprises a horizontal element attached at two horizontal ends to said innerbody and separated from said innerbody by spaces located along upper and lower edges of said horizontal element.

5. An incremental feel cosmetic dispenser in accordance with claim 1, wherein said resilient tab comprises a horizontal element attached at one horizontal end to said innerbody and separated from said innerbody by spaces located along three edges of said horizontal element.

6. An incremental feel cosmetic dispenser in accordance with claim 1, wherein said resilient tab comprises a vertical element attached at two vertical ends to said innerbody and separated from said innerbody by spaces located along lateral edges of said vertical element.

7. An incremental feel cosmetic dispenser in accordance with claim 1, further comprising a generally cylindrical elevator cup for containing a cosmetic preparation, fitted into said innerbody and having a cam follower lug extending through said longitudinal track to engage said helical thread, said elevator cup being movable in an axial path by relative rotation of said innerbody and cam sleeve.

8. An incremental feel cosmetic dispenser, comprising:

a tubular cam sleeve having upper and lower ends and inner and outer walls and having an internal helical thread extending along a substantial length of the inner wall of said cam sleeve;

a tubular innerbody having upper and lower ends, said innerbody being fitted into said tubular cam sleeve and being provided with a longitudinal track extending through the wall of said innerbody along a substantial length of said innerbody;

a resilient rounded tab element formed with and extending radially form one of said innerbody and cam sleeve; and a plurality of axially extending ribs formed on the other of said innerbody and cam sleeve so that said tab element will cam against said ribs upon the relative rotation of said innerbody and cam sleeve in both a dispensing and a retracting direction to provide a manual sensation of an incremental rotation feel to a user of said dispenser.

9. An incremental feel cosmetic dispenser in accordance with claim 8, further comprising a generally cylindrical elevator cup for containing a cosmetic preparation, fitted into said innerbody and having a cam follower lug extending through said longitudinal track to engage said helical thread, said elevator cup being movable in an axial path by relative rotation of said innerbody and cam sleeve.

10. An incremental feel cosmetic dispenser in accordance with claim 9, wherein said rib elements are provided on said cam sleeve and said tab element is provided on said innerbody.

11. An incremental feel cosmetic dispenser in accordance with claim 9, wherein said rib elements are provided on said innerbody and said tab element is provided on said cam sleeve.

12. An incremental feel cosmetic dispenser, comprising:

a rigid tubular cam sleeve having upper and lower ends and inner and outer walls and having two internal helical thread located 180 degrees apart and extending along a substantial length of the inner wall of said cam sleeve, and having an inner lower segment having a plurality of axially inwardly extending rounded ribs formed on said inner lower segment of said cam sleeve;

a tubular innerbody having upper and lower ends, said innerbody being fitted into said tubular cam sleeve and being provided with two longitudinal tracks extending through the wall of said innerbody along a substantial length of said innerbody;

two resilient flex tabs formed with and attached to said lower end of said innerbody and located about 180 degrees apart, said tabs being at least partially cut away form said innerbody to enhance resilience of said tabs, and each being provided with a radially outwardly extending rounded bump to frictionally engage and press against said ribs such that a manual sensation of an incremental rotation is provided to a user of said dispenser upon the relative rotation of said innerbody and cam sleeve in both a dispensing and a retracting direction; and a generally cylindrical elevator cup for containing a cosmetic preparation, fitted into said innerbody and having two cam follower lugs located 180 degrees apart and having a sufficient length to extend through said longitudinal tracks to engage said helical threads, said elevator cup being movable in an axial path by relative rotation of said inner body and cam sleeve.

13. An incremental feel cosmetic dispenser in accordance with claim 12, wherein at least one of said flex tabs comprises a horizontal element attached at one horizontal end to said innerbody and separated from said innerbody by spaces located along upper and lower edges of said horizontal element

14. An incremental feel cosmetic dispenser in accordance with claim 12, wherein at least one of said flex tabs comprises a horizontal element attached at one horizontal end to said innerbody and separated from said innerbody by spaces located along three edges of said horizontal element.

15. An incremental feel cosmetic dispenser in accordance with claim 12, wherein at least one of said flex tabs comprises a vertical element attached at two vertical ends to said innerbody and separated from said innerbody by spaces located along lateral edges of said vertical element.

* * * * *